US010024027B2

(12) United States Patent
Worth

(10) Patent No.: US 10,024,027 B2
(45) Date of Patent: Jul. 17, 2018

(54) MULTI-COMPONENT SHELL PROFILE FOR A BUCKET

(71) Applicant: Caterpillar Inc., Peoria, IL (US)

(72) Inventor: David Worth, Naperville, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/244,520

(22) Filed: Aug. 23, 2016

(65) Prior Publication Data

US 2018/0058034 A1 Mar. 1, 2018

(51) Int. Cl.
*E02F 3/40* (2006.01)

(52) U.S. Cl.
CPC ..... *E02F 3/40* (2013.01)

(58) Field of Classification Search
CPC ... E02F 3/40; E02F 3/42; E02F 3/3604; E02F 9/2808; E02F 9/2825; E02F 9/2833; E02F 9/2858
USPC ..... 37/379, 444; 414/722–724
See application file for complete search history.

(56) References Cited

U.S. PATENT DOCUMENTS 4,037,337 A * 7/1977 Hemphill ..... E02F 3/3604 37/444
4,129,952 A 12/1978 Olson
4,476,641 A * 10/1984 Ballinger ..... E02F 3/40 37/444
4,719,711 A * 1/1988 Sieber ..... E02F 3/40 37/444
5,815,959 A 10/1998 Bahner et al.
8,438,759 B2 5/2013 Imamura et al.
8,707,589 B2 * 4/2014 Hilton ..... E02F 3/3604 37/379
2010/0000129 A1 1/2010 Balemi et al.
2014/0237869 A1 8/2014 Caux et al.
2014/0305011 A1 10/2014 Leslie et al.
2015/0275467 A1 10/2015 Hall

* cited by examiner

*Primary Examiner* — Robert E Pezzuto
(74) *Attorney, Agent, or Firm* — Law Office of Kurt J. Fugman LLC

(57) ABSTRACT

A bucket comprises a shell including a curved member that defines a first transverse end, a second transverse end, a top edge and a bottom flat portion, a first flat angled member attached to the first transverse end of the curved member and a second flat angled member attached to a second transverse end of the curved member, a bottom member, and at least one attachment bracket, wherein the bucket assembly defines a bucket center plane and the first and second flat angled members are tapered toward the center plane of the bucket.

14 Claims, 6 Drawing Sheets

MULTI-COMPONENT SHELL PROFILE FOR A BUCKET

TECHNICAL FIELD

The present disclosure relates to the shell design of buckets used to move material such as dirt, stone, coal and the like. More particularly, the present disclosure is related to a shell profile design that uses multiple components.

BACKGROUND

Buckets are well known in the art for moving material such as dirt, stone, coal, etc. In some instances, material, especially re-handled coal, does not evacuate from the bucket properly during a dumping operation. This is often attributed to sticking of the material such as coal in the corners of the bucket. This reduces the productivity of a mining, construction or similar endeavor and may also increase the amount of fuel used during these types of operations as the material packs into the bucket, adding weight to the bucket undesirably. More specifically, in a coal handling application, the increased fuel burn occurs as the packed coal is transported back from the intended destination, such as a hopper, to the origin of the coal, such as the pile of the coal.

FIG. 1 depicts a bucket assembly 100 that is known in the art that is susceptible to such packing of material within the interior of the bucket. The bucket assembly 100 defines an opening 102 that communicates with a generally enclosed interior. Starting from the rear of the bucket assembly 100 as shown in FIG. 1, the bucket assembly 100 includes a curved shell profile 104, manufactured from a single component, which is attached to a rear wall 106 at the top end of the shell 104. The other end of the shell is attached to the bottom plate 108 of the assembly 100. A top plate 110 is attached to the top end of the rear wall 106. The top plate 110 transitions to a spill guard 112 that is designed to funnel material into the interior of the bucket and prevent material from spilling out of the bucket. Reinforcing ribs 118 are provided that are attached to the top plate 110 and the spill guard 112, providing reinforcement for strength. Two substantially flat end plates 114, only one of which is shown, is attached to the side edges of the spill guard 112, top plate 110, rear wall 106, bottom plate 108 and shell 104. A front edge assembly 116 is attached to the front edge of the bottom plate 108 of the bucket assembly 100. This assembly has proven to be prone to material sticking and wear issues.

SUMMARY OF THE DISCLOSURE

A bucket assembly is provided that may comprise a multi-component shell subassembly including an at least partially curved member that defines a first transverse end, a second transverse end, a top edge and a bottom flat portion. The assembly may also comprise a first flat angled plate attached to the first transverse end of the curved member and a second flat angled plate attached to the second transverse end of the curved member and a rear plate that is attached to the top edge of the curved member of the shell subassembly. A bottom plate may be attached to the bottom flat portion of the curved member of the shell subassembly.

A bucket assembly is provided that may include a multi-component shell subassembly including an at least partially curved member that defines a first transverse end, a second transverse end, a top edge and a bottom flat portion, and a first flat angled plate attached to the first transverse end of the curved member and a second flat angled plate attached to a second transverse end of the curved member, wherein the curved member defines a first thickness and either the first angled flat plate or second angled flat plate defines a second thickness, wherein the second thickness is less than the first thickness.

A bucket is provided that may comprise a shell including an at least partially curved member that defines a first transverse end, a second transverse end, a top edge and a bottom flat portion. The bucket may also include a first flat angled member attached to the first transverse end of the curved member and a second flat angled member attached to a second transverse end of the curved member, a bottom member that is attached to the bottom flat portion of the curved member of the shell subassembly, and at least one attachment bracket, wherein the bucket assembly defines a bucket center plane and the first and second flat angled members are tapered toward the center plane of the bucket.

DETAILED DESCRIPTION

Figure 1:
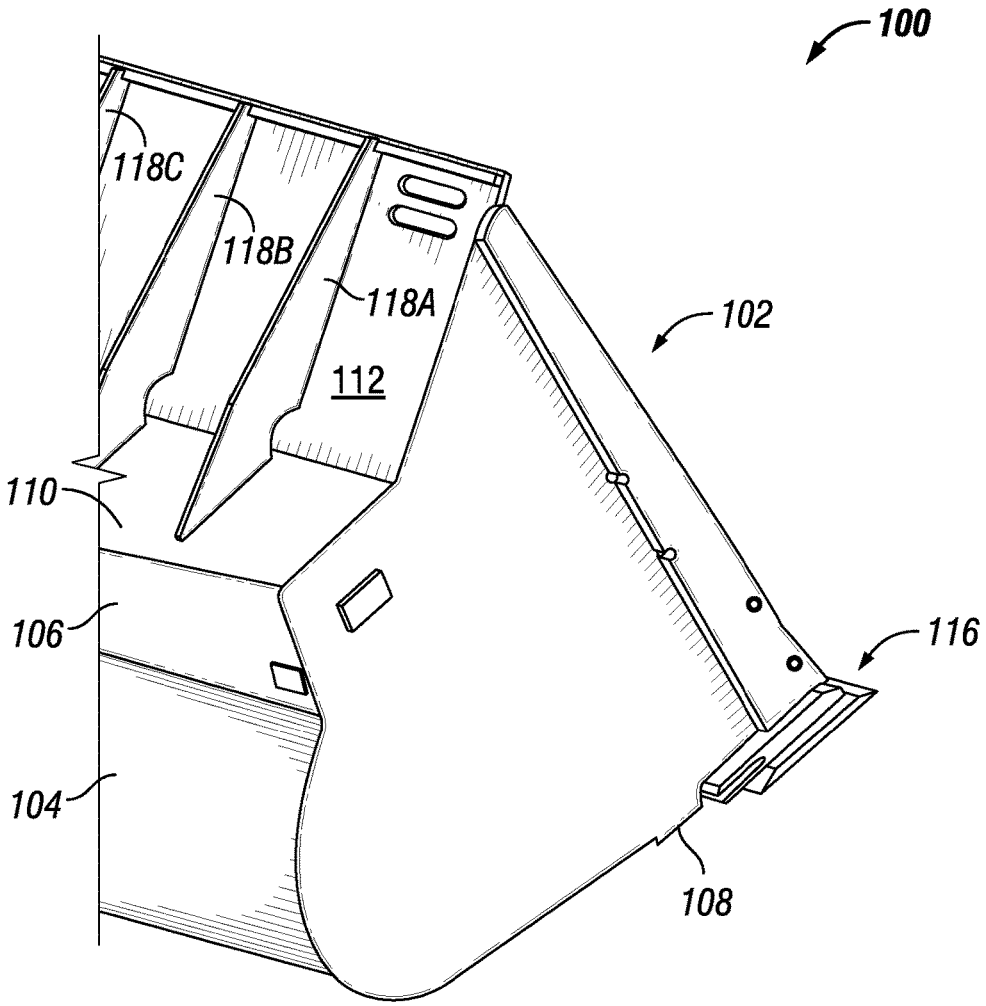
FIG. 1 is an enlarged rear perspective view of a prior art bucket using a single piece shell profile.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

This disclosure provides various embodiments of bucket assemblies that include the following features. In some embodiments, a new three piece shell profile is applied to shape the rear corners of the bucket in a manner which easily releases the material. That is to say, tight corners are reduced to prevent material packing. Material packed in the corners causes reduced productivity and increased fuel burn by carrying back material from the destination (hopper) back to the origin (pile) as previously mentioned. Additionally, in some embodiments, a thinner plate is applied to replace a traditionally thicker material in this area which results in a bucket weight reduction. The reduced bucket weight allows for a larger bucket to be designed to move more payload, resulting in better productivity for the customer. A third set of embodiments focus on the outside of the bucket shape. The cropped corners reduce drag on the bucket when entering the pile. The reduced drag forces can be transferred back to the cutting edge where they contribute to additional loading of material in the bucket and increased productivity. In the case of a full bucket, the reduced drag will improve fuel efficiency when sweeping through the pile, etc.

Figure 2:
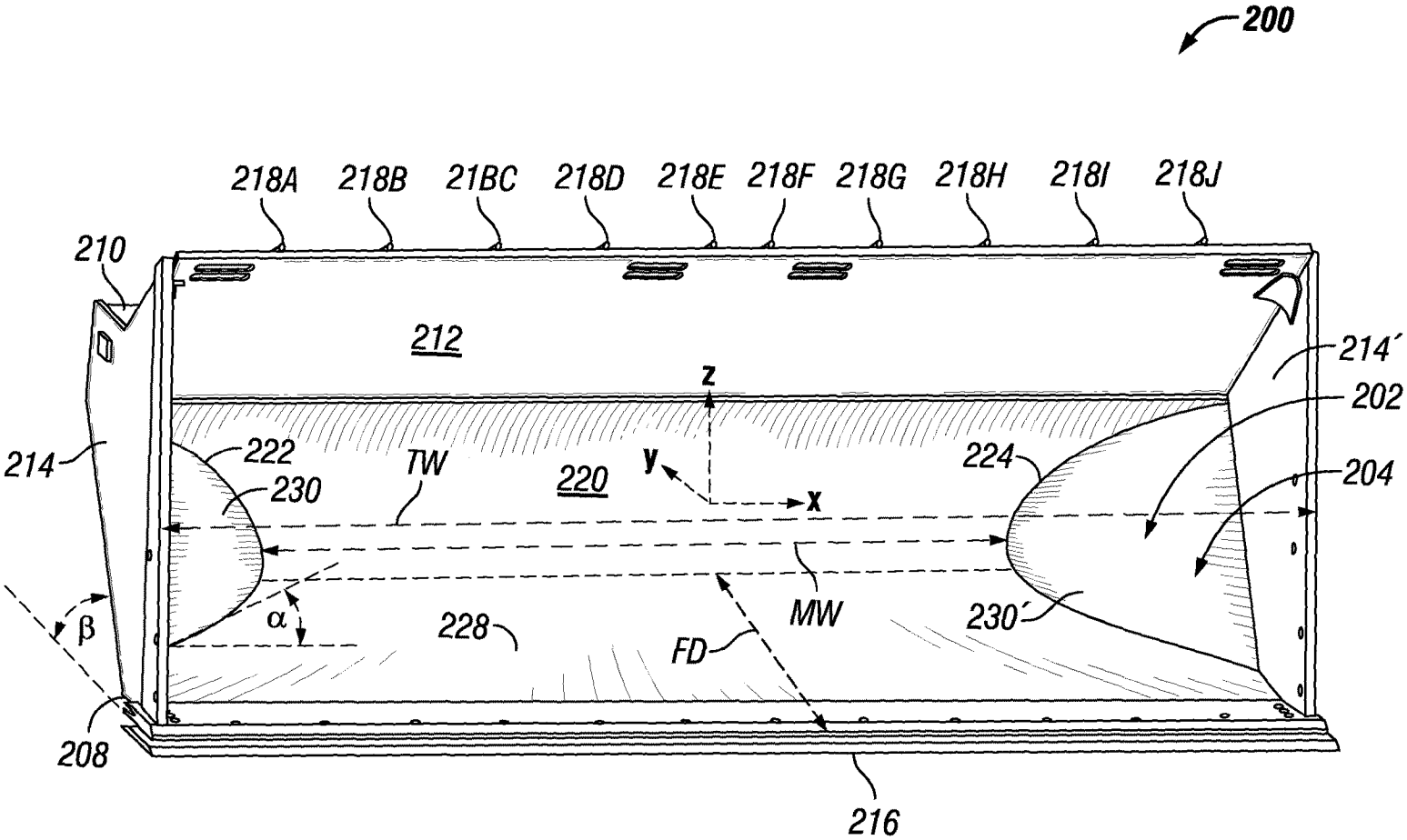
FIG. 2 is a front perspective view of a bucket using a multi-component shell profile according to an embodiment of the present disclosure.
Figure 3:
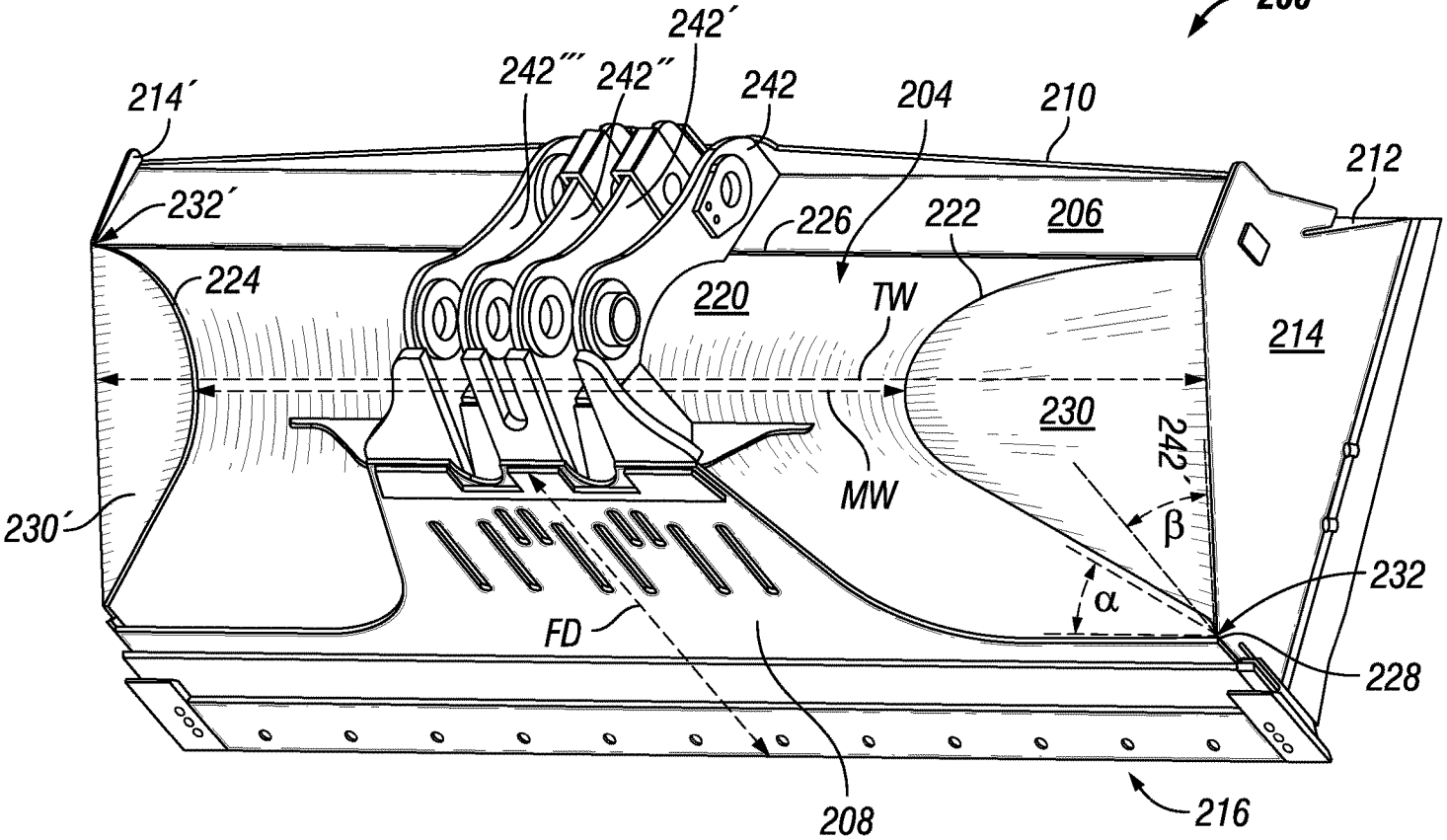
FIG. 3 is a rear perspective view of the bucket of FIG. 2, showing more clearly an angled component of the shell profile.

Looking at FIGS. 2 and 3, an embodiment of a bucket assembly 200 according to the present disclosure that improves or lessens the sticking of material in the interior 202 of the bucket is disclosed. The bucket assembly 200 comprises a multi-component shell subassembly 204 including an at least partially curved member 220 that defines a first transverse end 222, a second transverse end 224, a top edge 226 and a bottom flat portion 228. The assembly further includes a first flat angled plate 230 attached to the first transverse end 222 of the curved member 220 and a second flat angled plate 230' attached to a second transverse end 224 of the curved member 220, a rear wall 206 that is attached to the top edge 226 of the curved member 220 of the shell subassembly 204, and a bottom plate 208 that is attached to the bottom flat portion 228 of the curved member 220 of the shell subassembly 204.

At least one flat angled plate 230 forms a first acute angle $\alpha$ with the bottom plate 208, wherein said angle is projected onto the bottom plate 208 along a direction that is perpendicular to the bottom plate 208. This same flat angled plate may form a second acute angle $\beta$ with the bottom plate 208, wherein said angle is projected onto a plane that is perpendicular to the bottom plate 208 along a direction that is parallel to the bottom plate 208 and perpendicular to an end plate 114. The first acute angle $\alpha$ may range from 30 to 85 degrees while the second acute angle $\beta$ may range from 5 to 75 degrees.

Continuing to refer to FIGS. 2 and 3, the assembly 200 may further comprise at least one end plate 214 that is attached to each of the following: the rear wall 206, the curved member 220 of the shell subassembly 204, the at least one flat angled plate 230, and the bottom plate 208, forming at least point of intersection 232 where the curved member 220, flat angled plate 230 and end plate 214 meet. As shown in FIGS. 2 and 3, the assembly 200 may be symmetrical about a center plane so that two identically flat angled plates 230, 230' may be provided, etc. A Cartesian coordinate system is provided at the volumetric center of the interior 202 of the bucket assembly 200. As shown, the Y-Z plane defines a center plane or plane of symmetry while the X-Y plane is parallel with the bottom plate 208. Other features of the assembly include a spill guard 212, a top plate 210, a plurality of reinforcing ribs 218 and a front edge assembly 216 as were previously described with reference to FIG. 1.

The assembly 200 of FIGS. 2 and 3 may also define a total transverse width TW of the assembly 200 measured in the X direction, a minimum width MW of the shell subassembly 204 also measured in the X direction, and a floor depth FD of the assembly 200 which is measured in the Y direction. In order to preserve the original volume of the bucket when using cropped corners as compared to not using cropped corners, the inventor has determined that maintaining certain ratios may be useful. For example, a ratio of the transverse total width TW of the assembly 200 to the minimum width MW of the shell subassembly 204 may range from 1.05 to 5.2 or a ratio of the floor depth FD of the assembly 200 to the minimum width MW of the shell assembly 200 may range from 0.6 to 5.0.

Figure 4:
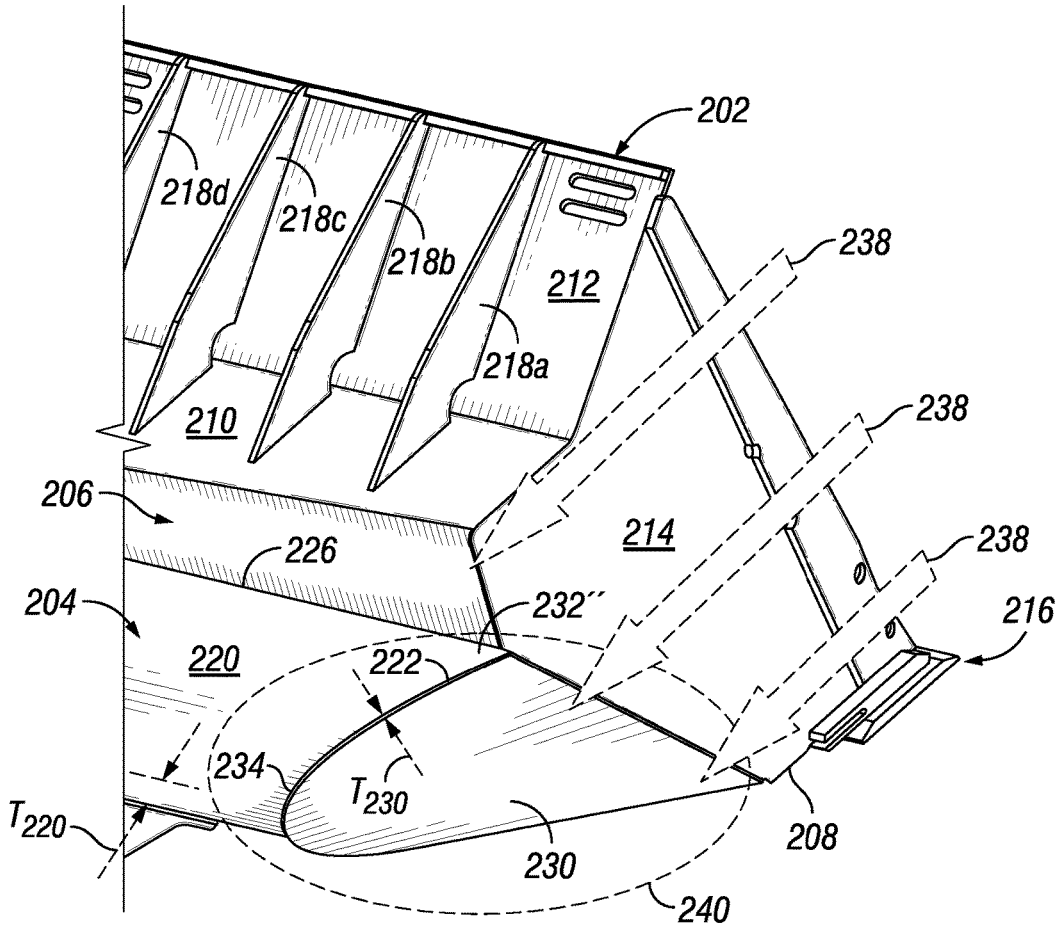
FIG. 4 is an enlarged rear perspective view of the bucket of FIG. 2, showing the typical flow of material pass the side plate of a bucket during a bucket loading or filling operation at the start of the operation.

As best seen in FIG. 4, it should also be noted that an angled plate 230 may extend past the other members it is attached to, providing a ledge 234 that may be useful when attaching the angled plate 230 to the other members using a weld bead.

Looking at FIGS. 2-4 together, features of an embodiment that improves the bucket performance in terms of strength versus weight, allowing a machine to expend less energy during a material moving operation will be described. The bucket assembly 200 may comprise a multi-component shell subassembly 204 including an at least partially curved member 220 that defines a first transverse end 222, a second transverse end 224, a top edge 226, and a bottom flat portion 228, and a first flat angled plate 230 attached to the first transverse end 222 of the curved member 220 and a second flat angled plate 230' attached to a second transverse end 224 of the curved member 220, wherein the curved member 220 defines a first thickness T220 (best seen in FIG. 4). Either the first angled flat plate 230 or second angled flat plate 230' defines a second thickness T230 (also best seen in FIG. 4), wherein the second thickness T230 is less than the first thickness T220.

In some embodiments, the first thickness T220 may range from 6 to 30 mm while the second thickness T230 may range from 4 to 25 mm. In an exemplary embodiment, the first thickness T220 may be about 25 mm and the second thickness T230 may be about 16 mm. A desired ratio of the first thickness T220 to the second thickness T230 may range from 1 to 3.

The assembly 200 may further comprise a rear wall 206 that is attached to the top edge 226 of the curved member 220 of the shell subassembly 204, a bottom plate 208 that is attached to the bottom flat portion 228 of the curved member 220 of the shell subassembly 204, and a spill guard 212 that is attached to the top plate 210. In addition, the assembly 200 may comprise at least one end plate 214 that is attached to each of the following: the rear plate 206, the curved member 220 of the shell subassembly 204, the spill guard 212, at least one flat angled plate 230 and the bottom plate 208. These various attachments may form at least one point of intersection 232 where the curved member 220, flat angled plate 230 and end plate meet 214.

Figure 5:
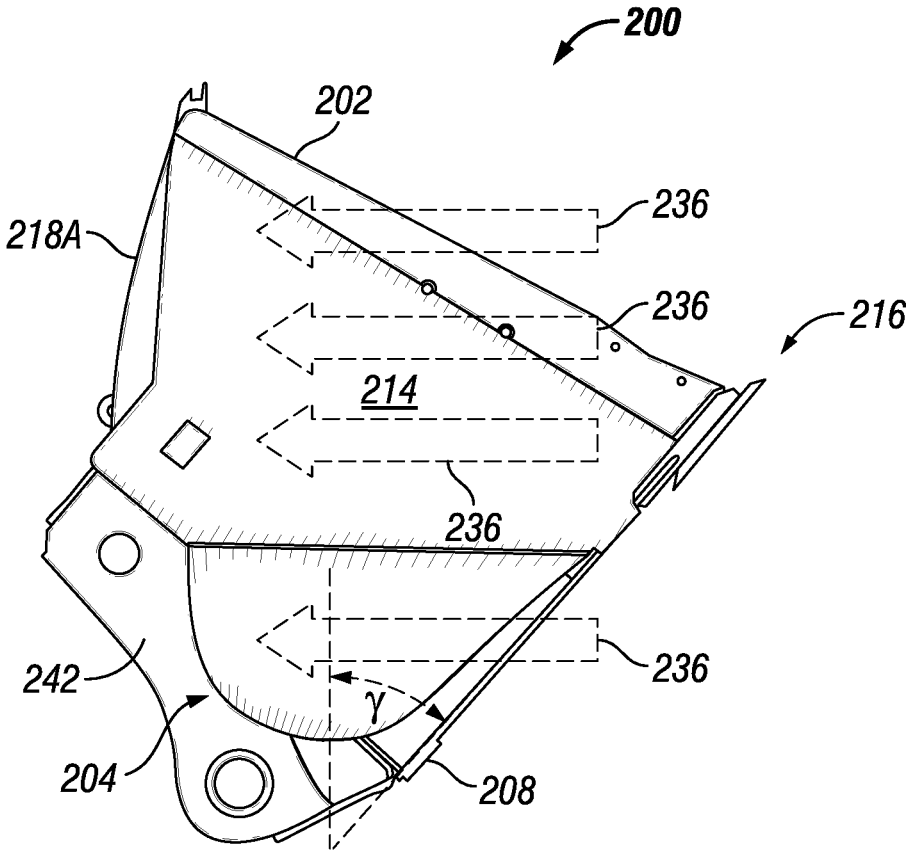
FIG. 5 is a side view of the bucket of FIG. 4 illustrating the typical flow of material past the side plate of the bucket at the end of a loading or filling operation of the bucket.

As best seen in FIG. 5, the first and second flat angled plates 230, 230' form a compound angle $\gamma$ with the bottom plate. This angle $\gamma$ is neither in a horizontal X-Y plane nor a vertical Y-Z plane when viewing FIGS. 3 and 4 together. Instead, as shown in FIG. 5, this angle $\gamma$ is produced by mitering or cropper a corner of the shell subassembly 204 in a manner extending into the page of FIG. 5 along the direction of arrows 236. A method for establishing this angle will be described later herein. Angle $\gamma$ may range from 15 to 85 degrees.

As also previously discussed with reference to FIG. 3, the assembly 200 may define a total transverse width TW of the assembly 200, a minimum width MW of the shell subassembly 204, and a floor depth FD of the assembly 200, wherein a ratio of the transverse total width TW of the assembly 200 to the minimum width MW of the shell subassembly ranges from 1.05 to 5.2 or wherein a ratio of the floor depth FD of the assembly 200 to the minimum width MW of the shell assembly 204 ranges from 0.6 to 5.0.

Referring now to FIGS. 3-5, an embodiment of a bucket assembly that is particularly well suited to reduce wear on the bucket during excavation or other material moving operations will now be discussed. In some cases, the energy efficiency of a machine using such a bucket design may also be improved. The bucket assembly 200 may comprise a multi-component shell subassembly 204 including an at least partially curved member 220 that defines a first transverse end 222, a second transverse end 224, a top edge 226 and a bottom flat portion 228. The assembly may further comprise a first flat angled plate 230 attached to the first transverse end 222 of the curved member 220 and a second flat angled plate 230' attached to a second transverse end 224 of the curved member 220, a rear plate 206 that is attached to the top edge 226 of the curved member 220 of the shell subassembly 204, and a bottom plate 208 that is attached to the bottom flat portion 228 of the curved member 220 of the shell subassembly 204. Attachment brackets 242 may be attached to the shell 204 and the rear plate 206, and the bucket assembly 200 defines a bucket center plane (see Y-Z plane in FIG. 2) and the first and second flat angled plates 230, 230' are tapered toward the center plane (Y-Z plane) of the bucket.

The first and second angled flat plates 230, 230' may form a compound angle $\gamma$ with the bottom plate 208 that is formed by tapering the corners 240 of the bucket assembly toward the center plane (Y-Z plane) of the bucket when the bucket is arranged in its most upward extent when attached to a machine. This position is depicted in FIG. 5 as well as the movement of material past the outside of the bucket assembly, shown by arrows 236, illustrating the wear mechanism that such buckets are exposed to during material moving operations. It is also in in this position where material loaded into the bucket experiences the most compaction, which can lead to material sticking in the bucket. FIG. 4 shows the wearing mechanism exerted on the bucket as it enters into a pile of material, denoted by arrows 238, while FIG. 5 illustrates the wearing mechanism exerted on the bucket as it exits the pile at the end of loading. Ellipse 240 shows that the tapering or cropping of the back corner of the bucket reduces drag area and force, helping to improve the energy efficiency of the machine as it moves the bucket to move material while also reducing the wear on the bucket.

As mentioned earlier herein with reference to FIG. 2, the bucket assembly 200 defines a vertical plane (Y-Z plane) that is a plane of symmetry for the bucket and the compound angle includes a first angle component $\beta$ projected onto the vertical plane along a horizontal direction (X direction), wherein the first angle component $\beta$ ranges from 5 to 75 degrees. The bucket assembly 200 also defines a horizontal plane (X-Y plane) and the compound angle $\gamma$ includes a second angle component $\alpha$ projected onto the horizontal plane (X-Y plane) along the vertical direction (Z direction), wherein the second angle component $\alpha$ ranges from 35 to 85 degrees.

Likewise, the curved member 220 may define a first thickness T220 and either the first angled flat plate or second angled flat plate 230 defines a second thickness T230, wherein the second thickness is less than the first thickness. The reasons for this difference in thickness will be explained more thoroughly later herein.

The assembly 200 typically also comprises at least one end plate 214 that is attached to each of the following: the rear plate 206, the curved member 220 of the shell subassembly 204, at least one flat angled plate 230, and the bottom plate 208, forming at least one point of intersection 232 where the curved member, flat angled plate and end plate meet. In this embodiment as best seen in FIG. 4, the rear plate 206 also joins the curved member 220, flat angled plate 230 and end plate 214 near the point of intersection 232", forming a four way intersection.

Other constructions of any of the embodiments discussed herein are possible including those with more or fewer components than have been explicitly described herein. For example, the assembly may be made unitary using a casting process. In which case, disparate members may be integrally formed with each other. In such a case, the terms "plate" or "wall", etc., may be replaced by the term "member", etc. Also, the "bucket assembly" may simply be referred to as a "bucket". This variance of the construction of the bucket may be applied to any of the embodiments discussed herein.

INDUSTRIAL APPLICABILITY

In practice, a bucket or bucket assembly may be sold, manufactured, bought or otherwise provided according to any of the embodiments described herein. In some applications, a bucket subassembly may be retrofitted or repaired with a shell subassembly according to any of the embodiments described herein. The parts and/or subassemblies needed for retrofitting or repairing may be sold, manufactured, bought or otherwise provided.

Any of the bucket assemblies as described herein may be attached to a work machine using a coupling mechanism that is now known or that will be devised in the art using attachment brackets, etc.

A method for designing and fabricating a bucket that is less prone to have material stick to its interior will now be described. Empirical or experimental evidence may be ascertained from buckets used to move material such as coal and the like. Over time, material may stick in the bucket due to compaction as has already been described. The stuck material may define a slip plane that indicates when the material is naturally prone to disengage or release and fall out of the bucket. The bucket may then be designed and fabricated with an angled plate that approximately matches this slip plane. This slip plane may vary depending on the shape of the bucket and type of material being used. Consequently, the specific design including the angles at which the corners of the bucket are cropped may vary from the values explicitly described herein but are to be considered within the scope of the present disclosure.

Similarly, a method for designing and fabricating a bucket that is less prone to wear may be describe as follows. Measurement of the wear of a bucket may be experimentally or empirically derived. Those areas subject to the most wear may be eliminated by cropping or altering the shape of the bucket to remove those areas. This may also reduce the drag on the bucket, improving the machine efficiency as already described.

In many embodiments, the sticking, wear and energy efficiency performances may be improved simultaneously by combining the designs optimized using both the methods just described. Indeed, in many applications the results of the design optimization involving both methods may greatly overlap as was the case for the embodiments explicitly described herein. This may not be true for other embodiments.

Figure 6:
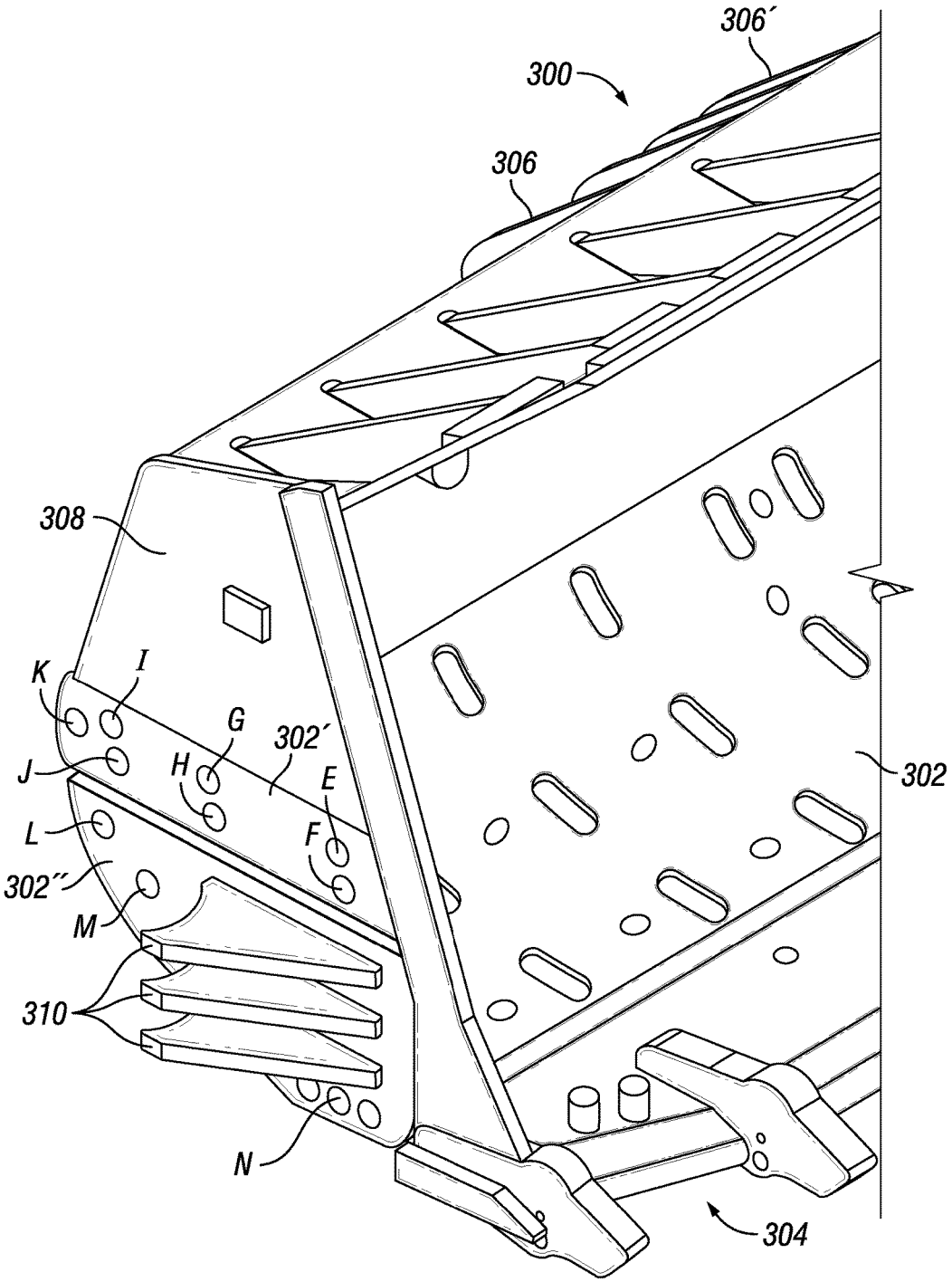
FIG. 6 is a diagram of a bucket with inspection points for measuring wear called out.

Finally, FIG. 6 illustrates an example of how to use empirical data to optimize the wear performance of a bucket. The bucket 300 in FIG. 6 was equipped with a plurality of wear plates 302 attached to the bucket 300. Each wear plate began with an initial thickness of 14 mm. Points E-N were then measured after 7100 hours of operation to see what the new thickness of the wear plates 302 was after being used repeatedly in a material moving operation. Next, these same plates were measured after 8500 hours of total operation. Table I produced below shows the amount of wear each of these points experienced over time.

Wear Data for FIG. 6

TABLE I

| Point on Bucket | Thickness-new | Thickness after 7100 hours of operation | Thickness after 8500 hours of operation |
|---|---|---|---|
| E | 14 mm | 12.4 | 12.0 |
| F | 14 mm | 12.1 | 11.2 |
| G | 14 mm | 11.7 | 11.3 |
| H | 14 mm | 11.4 | 10.7 |
| I | 14 mm | 10.7 | 9.2 |
| J | 14 mm | 9.6 | 8.2 |
| K | 14 mm | 8.4 | 7.6 |
| L | 14 mm | 8.1 | 6.5 |
| M | 14 mm | 12.8 | 11.3 |
| N | 14 mm | 11.6 | 8.5 |

As can be seen, the areas with the greatest amount of wear were located in the rear corner of the bucket 300 (see points I-L). The inventor then proceeded to optimize the shape of the bucket based on this data. The center of the bucket 300 was left essentially alone compared to previous designs as this area experienced the least amount of wear. Also, the middle portion of the bucket experiences the heaviest forces as the insertion or cutting force of the front edge assembly 304 is naturally prone to be conveyed to the center of the bucket where the attachment brackets 306 are located. Maintaining a thicker section here helps to support this load. On the other hand, the back corner of the bucket 300 receives very little of this load. Therefore, its design may be adjusted to be only be thick enough as needed to support the weight of the material when the bucket 300 is fully loaded. This explains why the angled plates are thinner than the middle portion of the shell.

The front of the side or end plate 308 (see points E-F) did not experience much wear. So, it did not need to be modified. However, this rear corner (see points I-L) experienced as much as 3-5 times as much wear as portions of the middle of the bucket, so by eliminating it, the wear and energy performances were improved. Also, by angling the back corner properly, the sticking performance of the bucket was also improved.

It should be noted that wings 310 are provided on this style of bucket 300. This wings 310 are intended to protect the tires of the machine from damage when moving rocks and stone, etc. These wings protect the portions of the bucket immediately behind them. This likely skewed the wear results for point M. For applications such as those discussed herein where coal is moved and such wings are not used or deemed necessary, one skilled in the art would expect point M to experience a higher rate of wear. Consequently, the inventor took this in consideration when angling the back corner of the buckets explicitly described herein.

While various embodiments have been described to be well suited for different applications and performance improvements, it is to be understood that many of the embodiments discussed herein may be able to improve performances other than those specifically mentioned regarding those embodiments.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the disclosure(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A bucket assembly comprising:

a multi-component shell subassembly including an at least partially curved member that defines a first transverse end, a second transverse end, a top edge and a bottom flat portion;

a first flat angled plate attached to the first transverse end of the curved member and a second flat angled plate attached to the second transverse end of the curved member;

a rear plate that is attached to the top edge of the curved member of the shell subassembly and extends upwardly therefrom; and a bottom plate that is attached to the bottom flat portion of the curved member of the shell subassembly;

wherein at least one of the flat angled plates forms a first acute angle with the bottom plate, wherein said angle is projected onto the bottom plate along a direction that is perpendicular to the bottom plate and the first acute angle ranges from 30 to 85 degrees.

2. The assembly of claim 1 wherein at least one of the first flat angled plate and the second flat angled plate form a second acute angle with the bottom plate, wherein said angle is projected onto a plane that is perpendicular to the bottom plate along a direction that is parallel to the bottom plate and the assembly defines a total transverse width of the assembly, a minimum width of the shell subassembly, and a floor depth of the assembly, wherein a ratio of the transverse total width of the assembly to the minimum width of the shell subassembly ranges from 1.05 to 5.2 or wherein a ratio of the floor depth of the assembly to the minimum width of the shell assembly ranges from 0.6 to 5.0.

3. The assembly of claim 2 wherein the second acute angle ranges from 5 to 75 degrees.

4. The assembly of claim 1 further comprising at least one end plate that is attached to each of the following:

the rear plate;

the curved member of the shell subassembly;

at least one of the first angled flat angled plate and the second angled flat plate; and the bottom plate, forming at least point of intersection where the curved member, at least one of the first flat angled plate and second angled flat plate and end plate meet.

5. The assembly of claim 4 wherein the assembly defines a total transverse width of the assembly, a minimum width of the shell subassembly, and a floor depth of the assembly, wherein a ratio of the transverse total width of the assembly to the minimum width of the shell subassembly ranges from 1.05 to 5.2 or wherein a ratio of the floor depth of the assembly to the minimum width of the shell assembly ranges from 0.6 to 5.0.

6. A bucket assembly comprising:

a multi-component shell subassembly including an at least partially curved member that defines a first transverse end, a second transverse end, a top edge and a bottom flat portion;

a first flat angled plate attached to the first transverse end of the curved member and a second flat angled plate attached to a second transverse end of the curved member; wherein the curved member defines a first thickness and either the first angled flat plate or second angled flat plate defines a second thickness, wherein the second thickness is less than the first thickness;

wherein the first and second flat angled plates form a compound angle with the bottom plate and the assembly defines a total transverse width of the assembly, a minimum width of the shell subassembly, and a floor depth of the assembly, wherein a ratio of the transverse total width of the assembly to the minimum width of the shell subassembly ranges from 1.05 to 5.2 or wherein a ratio of the floor depth of the assembly to the minimum width of the shell assembly ranges from 0.6 to 5.0.

7. The assembly of claim 6 further comprising a rear plate that is attached to the top edge of the curved member of the shell subassembly, a bottom plate that is attached to the bottom flat portion of the curved member of the shell subassembly, and a spill guard that is attached to the top plate.

8. The assembly of claim 7 further comprising at least one end plate that is attached to each of the following:

the rear plate;

the curved member of the shell subassembly;

the spill guard;

at least one of the first flat angled plate and second flat angled plate; and the bottom plate, forming at least one point of intersection where the curved member, flat angled plate and end plate meet.

9. A bucket comprising:

a shell including an at least partially curved member that defines a first transverse end, a second transverse end, a top edge and a bottom flat portion;

a first flat angled member attached to the first transverse end of the curved member and a second flat angled member attached to a second transverse end of the curved member;

a bottom member that is attached to the bottom flat portion of the curved member of the shell subassembly; and at least one attachment bracket, wherein the bucket assembly defines a bucket center plane and the first and second flat angled members are tapered toward the center plane of the bucket;

wherein the first and second angled flat members form a compound angle with the bottom plate, and the assembly defines a total transverse width of the assembly, a minimum width of the shell subassembly, and a floor depth of the assembly, wherein a ratio of the transverse total width of the assembly to the minimum width of the shell subassembly ranges from 1.05 to 5.2 or wherein a ratio of the floor depth of the assembly to the minimum width of the shell assembly ranges from 0.6 to 5.0.

10. The bucket of claim 9 wherein the bucket assembly defines a vertical plane that is a plane of symmetry for the bucket and the compound angle includes a first angle component projected onto the vertical plane along a horizontal direction, wherein the first angle component ranges from 5 to 75 degrees.

11. The bucket of claim 9 wherein the bucket assembly defines a horizontal plane and the compound angle includes a second angle component projected onto the horizontal plane along the vertical direction, wherein the second angle component ranges from 30 to 85 degrees.

12. The bucket of claim 9 wherein the curved member defines a first thickness and either the first angled flat plate or second angled flat plate defines a second thickness, wherein the second thickness is less than the first thickness.

13. The bucket of claim 9 wherein the shell includes a multi-component subassembly and the bucket further comprises a rear plate that is attached to the top edge of the curved member of the shell subassembly and at least one end plate that is attached to each of the following:

the rear plate;

the curved member of the shell subassembly;

at least one of the first flat angled member and the second flat angled member; and the bottom member, forming at least one point of intersection where the curved member, flat angled member and end plate meet.

14. The assembly of claim 13 wherein the rear plate also joins the curved member, at least one of the first flat angled member and the second flat angled member and end plate near the point of intersection, forming a four way intersection.

* * * * *